United States Patent [19]

Kasper et al.

[11] Patent Number: 4,675,935

[45] Date of Patent: Jun. 30, 1987

[54] CONTROL AND MONITOR FOR A FLOOR MAINTENANCE DEVICE

[75] Inventors: Joseph G. Kasper, Golden Valley; Bruce F. Field; Keith R. Westrum, both of Minneapolis; Charles E. Grimes, Bloomington, all of Minn.

[73] Assignee: Tennant Company, Minneapolis, Minn.

[21] Appl. No.: 839,878

[22] Filed: Mar. 14, 1986

[51] Int. Cl.[4] ..... A47L 11/204

[52] U.S. Cl. ..... 15/319; 15/320; 15/340

[58] Field of Search ..... 15/319, 320, 340, 339

[56] References Cited

U.S. PATENT DOCUMENTS

| | | | |
|---|---|---|---|
| 3,216,036 | 11/1965 | Rockwood et al. | 15/319 X |
| 3,456,275 | 7/1969 | Solomon | 15/319 X |
| 3,952,361 | 4/1976 | Wilkins | 15/319 |
| 4,114,711 | 9/1978 | Wilkins | 15/319 X |
| 4,207,649 | 6/1980 | Bates | 15/321 X |

*Primary Examiner*—Chris K. Moore

*Attorney, Agent, or Firm*—Kinzer, Plyer, Dorn & McEachran

[57] ABSTRACT

A floor scrubber has rotating brushes for scrubbing a floor, drive motors for the brushes, and a brush height control circuit for raising and lowering the brushes in accordance with a desired brush pattern. The scrubber includes a solution tank, a recovery tank and a detergent tank for application and recovery of the cleaning solution. A solution tank pump, a detergent tank pump and a fan for use in vacuuming used cleaning solution into the recovery tank are each connected to their respective tanks. There are actuating means connected to the brush drive motors, pumps, fan and brush height control circuit. Sensors monitor the solution tank, recovery tank and detergent tank, as well as the speed of the floor scrubber. A start signal for the actuating means is only provided when the sensors determine certain prestart conditions have been met in the solution tank, recovery tank, detergent tank and a certain predetermined speed has been reached for the floor scrubber.

21 Claims, 6 Drawing Figures fig.1.
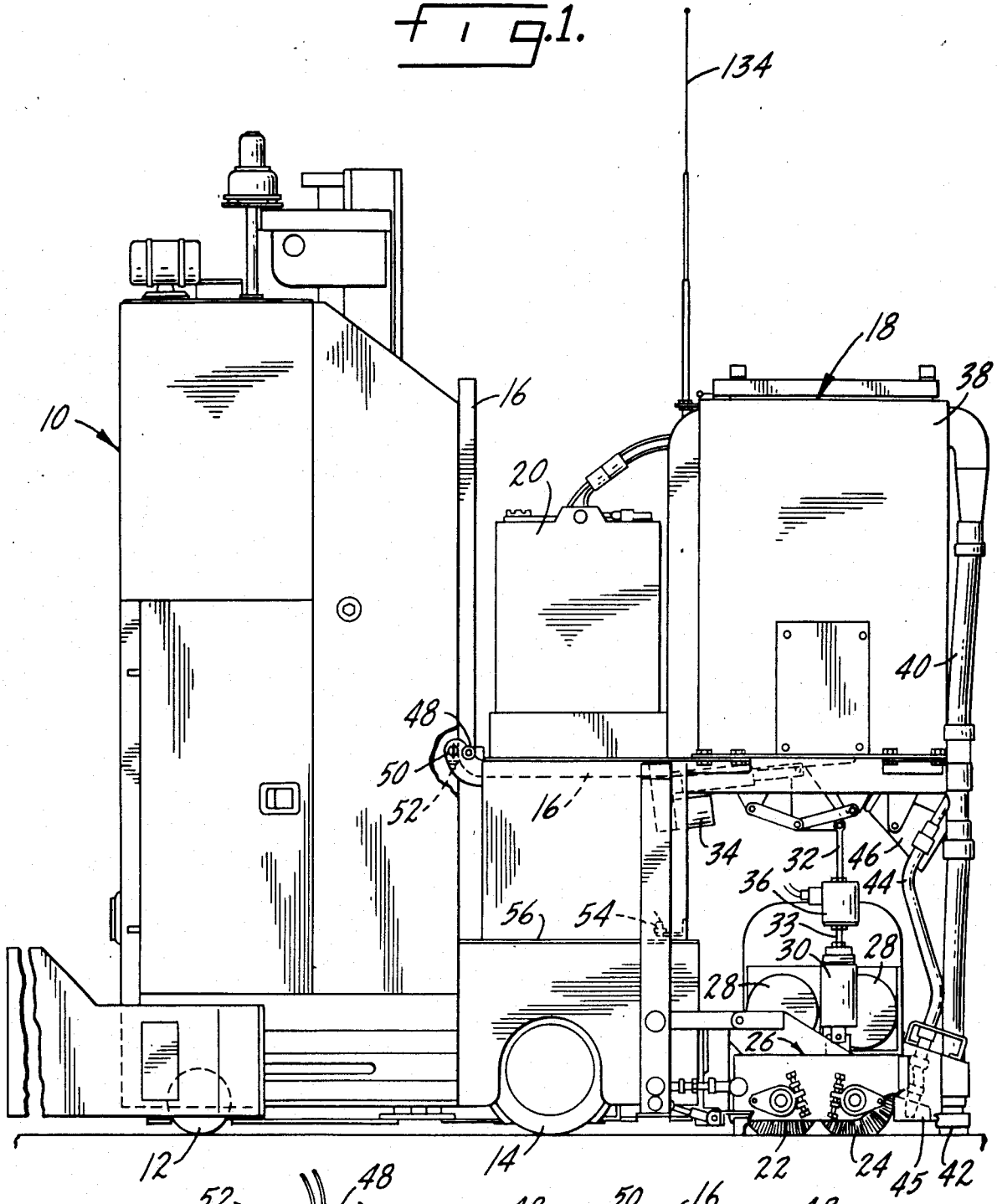
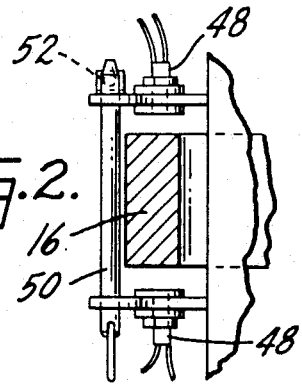
fig.2.
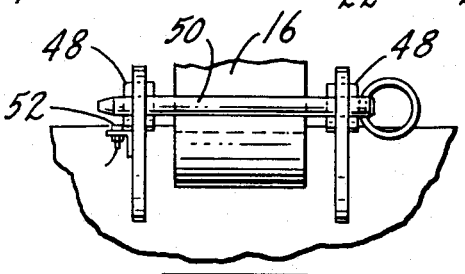
fig.3.

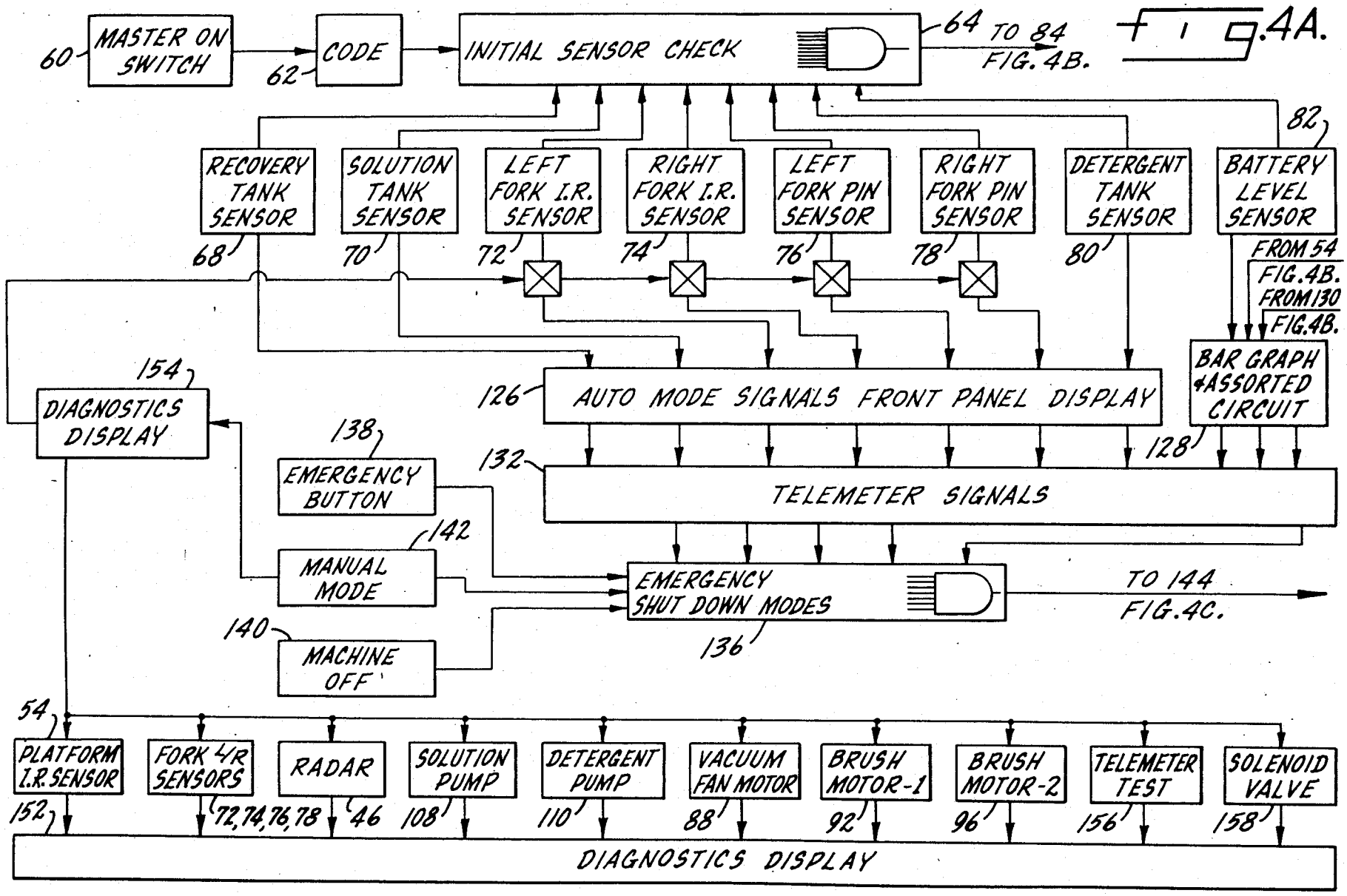
FIG. 4A.
MASTER ON SWITCH
60
CODE
62
INITIAL SENSOR CHECK
64
TO 84 FIG. 4B.
RECOVERY TANK SENSOR
68
SOLUTION TANK SENSOR
70
LEFT FORK I.R. SENSOR
72
RIGHT FORK I.R. SENSOR
74
LEFT FORK P/N SENSOR
76
RIGHT FORK P/N SENSOR
78
DETERGENT TANK SENSOR
80
BATTERY LEVEL SENSOR
82
FROM 54
FIG. 4B. FROM 130
FIG. 4B.
BAR GRAPH & ASSORTED CIRCUIT
128
AUTO MODE SIGNALS FRONT PANEL DISPLAY
126
TELEMETER SIGNALS
132
TO 144 FIG. 4C.
EMERGENCY SHUT DOWN MODES
136
EMERGENCY BUTTON
138
MANUAL MODE
142
MACHINE OFF
140
DIAGNOSTICS DISPLAY
154
PLATFORM I.R. SENSOR
152
54
FORK L/R SENSORS
72, 74, 76, 78
RADAR
46
SOLUTION PUMP
108
DETERGENT PUMP
110
VACUUM FAN MOTOR
88
BRUSH MOTOR-1
92
BRUSH MOTOR-2
96
TELEMETER TEST
156
SOLENOID VALVE
158
DIAGNOSTICS DISPLAY

CONTROL AND MONITOR FOR A FLOOR MAINTENANCE DEVICE

SUMMARY OF THE INVENTION

The present invention relates to a floor maintenance machine having rotating brushes and in particular to means for monitoring and controlling machine operation.

A primary purpose of the invention is a surface maintenance machine, which may be operated on an unattended vehicle, which includes means for monitoring the surface maintenance machine's functions and controlling its operation in accordance with the monitored functions.

Another purpose is a surface maintenance machine which includes telemetry for reporting to a remote location the monitored conditions and functions of the surface maintenance machine.

Another purpose is a surface maintenance machine which includes sensors for monitoring certain preoperating conditions associated therewith, including machine movement, and which will not permit starting of the maintenance operation until the preoperating conditions have been met, which includes a predetermined machine speed.

Another purpose is a surface maintenance machine of the type described which includes sensors and control circuits which function to both start up and stop the machine in accordance with the sensed operating conditions.

Another purpose is a surface maintenance machine which is removably mounted on an unattended vehicle and which includes among its monitored functions the position and security of the machine on its vehicle.

Another purpose is a surface maintenance machine which is removably mounted on a vehicle so that the vehicle is available for other uses when it is not desired to perform surface maintenance work.

Another purpose is a surface maintenance machine driven by an operator in which control of the surface maintenance functions is automated, thereby reducing the driver's workload and requiring him to do nothing other than the starting, stopping, steering and speed control of the vehicle.

Other purposes will appear in the ensuing specification, drawings and claims.

BRIEF DESCRIPTION OF THE DRAWINGS

The invention is illustrated diagrammatically in the following drawings wherein:

FIG. 1 is a side view of a scrubber mounted upon an unattended vehicle, and

FIGS. 2 and 3 are details of the sensors used to monitor scrubber position, and FIGS. 4A, 4B and 4C together constitute a block diagram for the control circuit used on the scrubber of FIG. 1.

DESCRIPTION OF THE PREFERRED EMBODIMENT

Figure 4B:
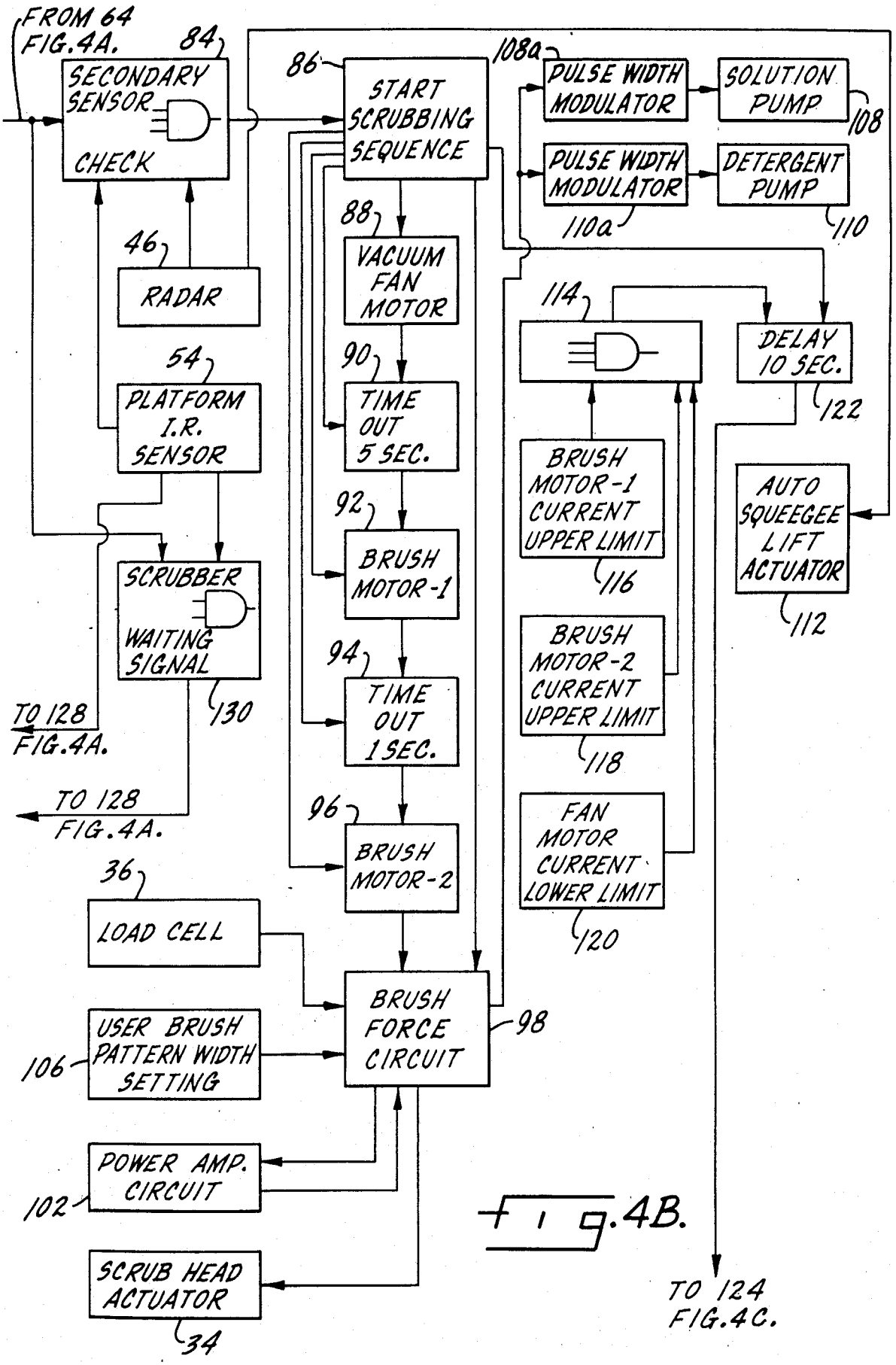

The present invention is concerned with surface maintenance machines, particularly scrubbers and sweepers. As described herein, the floor maintenance machine comprises an unattended self-propelled vehicle, for example a forklift truck which mounts a self-contained scrubber. The scrubber is essentially a passenger on the vehicle and does not have control over vehicle speed. Because the vehicle is unattended or without an operator, it is necessary that the scrubber have a control system which monitors various of its functions, as well as certain conditions of the scrubbing apparatus. The monitored conditions, in addition to providing a means for maintaining control of the scrubber operation, are also transmitted to a control site wherein an operator may monitor the operations of one or more scrubbers, all of which may be unattended.

Although the invention will be described in connection with a vehicle which mounts a scrubber and on which the scrubber is removably positioned, the invention is not so limited. The scrubber controls and monitors may be equally applicable to an integrated scrubbing or sweeping unit. Even though the scrubber described does not utilize an operator actually on the machine, again the controls and monitors may be applicable to a scrubbing apparatus in which the operator is in attendance, but because of the size or use of the machine, it is required that there be constant monitoring of machine operation. This would be particularly true in those instances in which the operator could not himself visually observe the various conditions which are sensed and controlled by the monitors. Also, automatic monitoring and control of the scrubber functions will substantially reduce the required driving skill, allowing a less skilled operator to use the machine.

Although the invention will be described in detail in connection with a scrubber, it should be understood that many, if not all, of the various sensors, monitors and controls are equally applicable to a sweeping apparatus, the principal difference being that in a sweeping apparatus there is no cleaning solution which is applied to the floor and no recovery tank or squeegee which are used to suck up the cleaning solution after it has performed its function.

In FIGS. 1 and 2, a vehicle is indicated generally at 10 and may have wheels 12 and 14. The vehicle as shown is a forklift truck, its forks being indicated at 16. In the particular application shown, the truck or vehicle is unattended in that it does not have an operator present.

Mounted upon the forks 16 of truck 10 is a scrubbing apparatus indicated generally at 18. The scrubbing apparatus has a battery 20 to provide power. The vehicle 10 will be propelled by its own power and the scrubbing apparatus will have no control over the speed or movement of the vehicle.

A pair of counter rotating scrubbing brushes 22 and 24 are a part of a scrub head 26. These are shown as cylindrical brushes rotating about horizontal axes. However, they could also be disc brushes rotating about vertical axes, as is well known in the art. Drive motors 28 drive the brushes. These are shown as electric motors, but in practice hydraulic motors are often used for this purpose and can be accomodated within the scope of the invention. The battery 20 could be replaced by a gasoline or diesel engine driving a hydraulic pump. The scrub head is mounted by means of a spring load mounting 30 and threaded rods 32 and 33 to an actuator 34 which is used to raise and lower the scrub head and thus the rotating brushes. A load cell 36 is a part of the mounting for the scrub head and is used to determine whether or not the brush weight actually upon the surface being treated is consistent with the desired force of brush application to the surface. The details of the brush height control apparatus are disclosed in a copending application filed simultaneously herewith.

The scrubbing apparatus will include a solution tank and a solution pump and a detergent tank and a detergent pump. Together this apparatus will supply a cleaning solution to the floor. Alternatively, the detergent tank and both pumps may be eliminated. In that case detergent may be mixed with water in the solution tank prior to operation and the mixture may flow by gravity through a shut-off valve to the floor. The cleaning solution will be sucked up to a recovery tank, which is indicated at 38, through a vacuum pickup apparatus which includes a hose 40 connected to the recovery tank and to the squeegee apparatus indicated generally at 42. A vacuum pickup 44 is mounted directly in front of the squeegee to pick up water from tray 45 which catches debris which has been loosened by the scrubbing brushes. All of the above-described apparatus is conventionally found in scrubbers, although not necessarily constructed and positioned in the manner disclosed above.

Because the scrubbing apparatus is merely riding upon the vehicle, it is necessary that there be a means to detect the speed and direction of the vehicle prior to the time that the scrubbing apparatus is actuated. A radar velocity sensor is indicated at 46 and is conventional to the extent that it is used to sense speed and direction of the vehicle. Other forms of speed and direction sensing devices may be equally satisfactory. For example, a rotation sensor might be applied to wheel 14.

In addition to checking on the speed of the vehicle, it is necessary to insure that the scrubbing apparatus is properly attached to the vehicle and is at the proper height above the floor surface. To this end, there are infrared photoelectric sensors, for each fork of the forklift, the sensors being indicated at 48 in FIGS. 2 and 3, and each will provide a signal indicating that in fact the scrubbing apparatus is properly mounted on the fork. Also, there are safety pins, one for each fork of the forklift, indicated at 50, with the safety pins having associated pin sensors 52, to indicate that the locking pins are in position on the forks, thereby insuring that the scrubbing apparatus will be maintained in position. Further, there is a platform sensor 54 which is effective to sense the relationship between the scrubbing apparatus and a platform 56 forming a part of the forklift truck which supports the scrubbing apparatus. All of these sensors must be operable prior to the time that the scrubbing operation can begin.

Figure 4C:
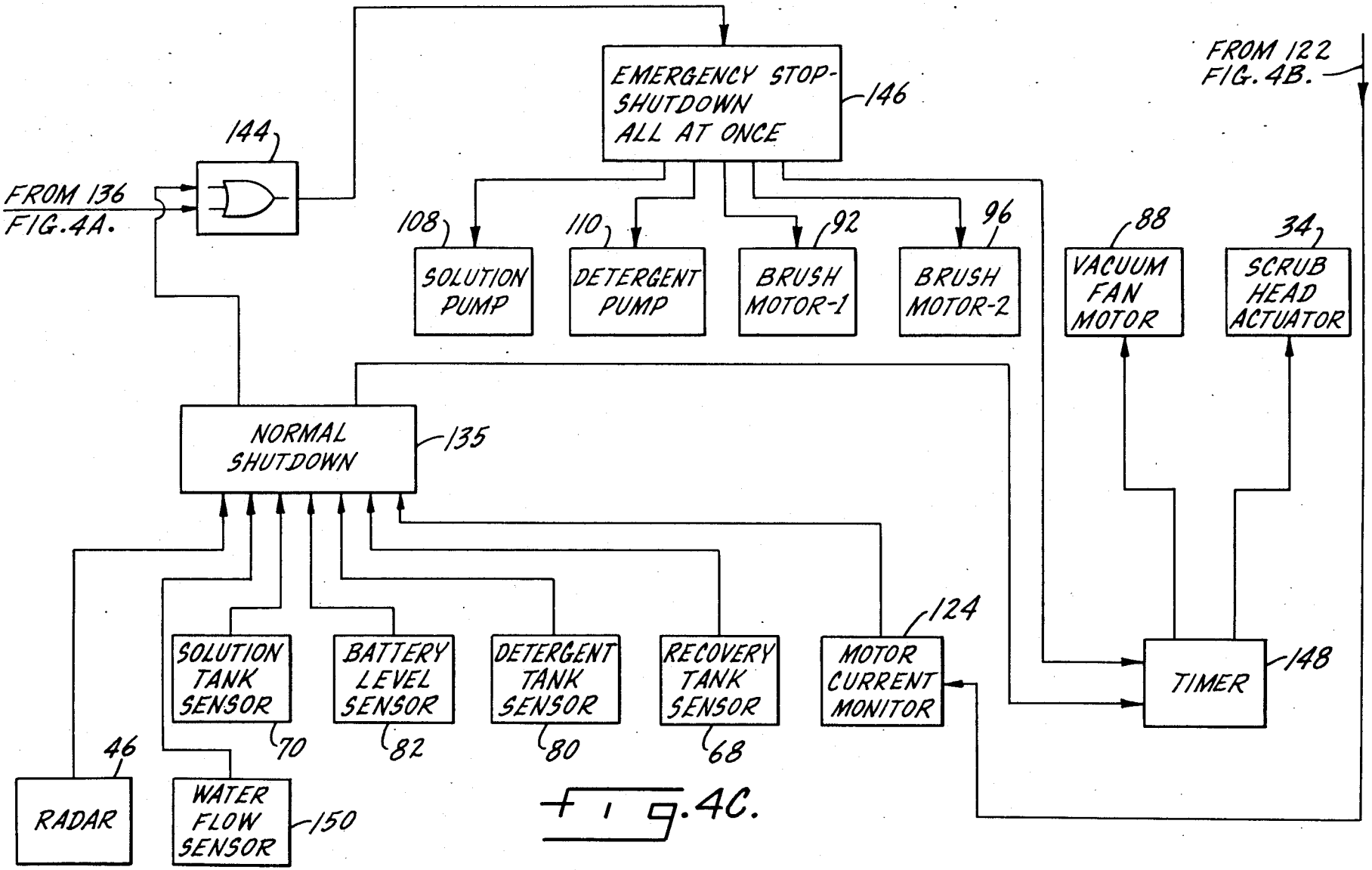

Referring to FIGS. 4A, 4B and 4C, which together form a block diagram of the control system for the scrubber, a master "on" switch is indicated at 60 and is used by the operator to initiate scrubbing operations. Switch 60 is connected to a security code device 62 in which the operator must punch the appropriate security code before the equipment is turned on. Assuming an appropriate code applied to code box 62, a start signal is sent to an initial sensor check 64 which is an AND gate having inputs from various sensors; a recovery tank sensor 68, which will indicate that the recovery tank has sufficient empty volume to receive recovered fluid; a solution tank sensor 70 which will indicate that there is sufficient solution in the tank to proceed with scrubbing; a left fork infrared sensor 72 and a right fork infrared sensor 74; a left fork pin sensor 76 and a right fork pin sensor 78; a detergent tank sensor 80; and a battery level sensor 82. The sensors 72, 74, 76 and 78 are all utilized to determine if the scrubbing apparatus is properly mounted on its vehicle. Detergent tank sensor 80 indicates that there is adequate detergent in the tank and battery level sensor 82 provides an indication that battery charge is at a level sufficient to operate the scrubber.

Assuming each of the sensors 66-82 provide an OK signal to sensor check 64, there will be an output to a secondary sensor check 84. The radar velocity sensor indicated at 46 provides a signal to secondary sensor 84 which indicates that a certain predetermined speed has been attained by the vehicle, as otherwise the scrubbing apparatus will not start. In addition, platform infrared sensor 54 provides a signal to secondary sensor 84 to indicate that the scrubber is "resting" or "properly seated" or "sitting on" or "supported by" the vehicle platform. Again, assuming that each of the sensors indicates a "go" condition, secondary sensor 84 will provide an output which will start the scrubbing sequence.

The scrubbing sequence control is indicated at 86 and receives its input from secondary sensor 84. It provides a plurality of outputs, all of which are designed to turn on and control a vacuum fan 88, #1 brush motor 92 and #2 brush motor 96. In the start sequence, the vacuum fan will start first. After a fivesecond interval controlled by timer 90 the first brush motor will start, and after a one-second interval controlled by timer 94 the second brush motor will start, with the starting being staggered to avoid excessive current drain on the battery. In the event that the fan and/or brushes are powered by hydraulic motors, the controls 88, 92 and 96 will be solenoid valves supplying hydraulic fluid to the motors.

Start scrubbing sequence circuit 86 also controls a brush pattern circuit 98 which is connected to scrub head actuator 34, a power amplifier 102, a load cell 36 and a brush width pattern set circuit 106. The operator determines the desired brush pattern with circuit 106. The load cell measures the weight of the scrubbing apparatus not being carried by the floor which determines if the desired down force is being applied by the brush to the floor. There is a comparison between the output from the load cell and brush pattern set circuit 106 and the scrub head actuator raises or lowers the brushes in accordance therewith. Brush circuit 98 further is effective to raise the brushes clear of the floor for transport.

When the brushes are running and at the proper height, the brush force circuit 98 will turn on solution pump 108 and detergent pump 110. These are powered through pulse width modulators 108*a* and 110*a* respectively, by means of which the desired flow rates may be set into pumps 108 and 110. As indicated above, radar 46 not only provides an indication of speed, but also of direction. Thus, a signal from radar 46 is connected to an auto squeegee lift actuator 112. If the vehicle is going in the reverse direction, it is necessary to raise the squeegee to avoid damage to its rubber lip and this is done by the electric actuator 112.

An AND gate is indicated at 114 and receives inputs from brush motor current sensors 116 and 118 and a further input from a fan motor current sensor 120. Sensor 120 will signal when fan motor current drops off due to a low vacuum in the vacuum fan, which may indicate a torn or inoperative squeegee. AND gate 114 is connected to a ten-second delay circuit 122, which in turn receives a start signal from sequence control 86. If any one of sensors 116, 118 or 120 provides an indication of an incorrect operating condition, and that condition persists for the ten-second delay initiated by the signal from sequence circuit 86, an output will be provided from the delay circuit to a motor current monitor 124.

To summarize the circuit described thus far, before the scrubbing sequence can begin, the control circuit insures that the recovery tank, solution tank and detergent tank are all at proper levels for operation. There is an assurance that the scrubbing apparatus is properly mounted upon its vehicle and that there is adequate battery voltage to operate the scrubber. Once these checks are ascertained to all be satisfactory, then the speed of the vehicle is checked, as is the position of the vehicle on its supporting platform. Again, assuming that each of these sensors indicates a correct condition, the brush motors, solution pump, detergent pump and fan motor are all started and the scrubbing operation commences.

There is a front panel display 126 which receives condition signals from most of the various sensors which are connected to initial sensor check 64. In addition, there is a further display 128 which will provide a visual indication of battery voltage and the condition of platform sensor 54. A signal from a scrubber waiting circuit 130 receiving one input from platform sensor 54 and a second from initial sensor check circuit 64 is also part of display 128. The scrubber waiting display indicates that the scrubber is in condition or ready to operate when the vehicle reaches a predetermined speed.

Both displays 126 and 128 are connected to a telemetry circuit 132 which will transmit signals representative of the various conditions of the sensors and monitors over an antenna 134, indicated in FIG. 1, to a remote location where the operator may monitor a number of similar vehicles. In some types of scrubbing apparatus the telemetry signals merely may go to another part of the vehicle where the operator is located. In any event, the telemetry device does transmit electric signals indicative of the conditions of the sensors to a location remote from the sensors themselves.

In addition to controlling the start of a scrubbing operation, it is necessary to monitor the various control functions during scrubbing and to provide means for automatically shutting down the machine in the event there is a malfunction or one of the sensors indicates an improper condition. There is a normal shutdown control circuit 135 and an emergency shutdown circuit 136. An emergency button 138, a machine off button 140 and a manual mode button 142 are all connected to the emergency shutdown circuit 136, as are certain inputs from the telemetry circuit 132. The particular inputs from the telemetry circuit are monitor signals from left fork sensor 72, right fork sensor 74, left fork pin sensor 76 and right fork pin sensor 78. Thus, if for some reason the scrubbing machine is loose or is not being correctly carried by the vehicle, there will be an emergency shutdown. Any one of the inputs to emergency shutdown circuit 136 will provide an output from its AND gate to an OR gate 144. A second input to the OR gate is a signal from normal shutdown circuit 135. The output from OR gate 144, which will be provided in the event of an input from either source, is a stop signal to emergency shutdown stop circuit 146. This circuit is connected to and provides a stop signal to solution pump 108, detergent pump 110, brush motor 92, brush motor 96 and an output to a timer circuit 148. The other input to timer 148 is the output from normal shutdown circuit 135. After a predetermined time interval, timer 148 will shut down fan motor 88 and will send a raise signal to scrub head actuator 34.

The normal shutdown mode, for other than one of the emergency conditions mentioned, is brought about by a signal from motor current monitor 124; from recovery tank sensor 68; from detergent tank sensor 80; from battery level sensor 82; from solution tank sensor 70; from radar 46; or from water flow sensor 150 which is a further sensor insuring that water is in fact flowing onto the floor as the scrubber is operating. Thus, any one of the above-described conditions will cause a shutdown of all of the pumps, fan and brush motors which are associated with the scrubbing operation.

At times it is required that an operator troubleshoot the machine and for this purpose there is a diagnostic display panel 152 which is connected to a diagnostic display circuit 154 which receives an input from manual mode switch 142. Operation of manual mode switch 142 provides a voltage to diagnostic display circuit 154 so that any one of the following designated sensors can be activated to start or stop or monitor a particular sensor, pump, brush motor or the like. Connected to and receiving a voltage from diagnostic display control 154 is platform sensor 54; left and right fork sensors 72, 74, 76 and 78; radar 46; solution pump 108; detergent pump 110; fan motor 88; brush motor 92; brush motor 96; a telemetry test circuit for the telemetry control indicated at 156 and a solenoid valve 158 for shutting off the flow of cleaning solution and detergent to the floor.

The floor maintenance means disclosed and described herein is designed for use on an unattended vehicle in which the floor maintenance machine does not have control over vehicle operation, particularly vehicle speed. Thus, it is required that all of the functions of the maintenance machine, whether it be a scrubber or a sweeper, be monitored and that various pre-turn-on conditions be met before the scrubbing sequence starts. There are a number of sensors which monitor those parts of the machine which must be in a certain condition before scrubbing can begin. Further, there is a speed sensor as the scrubber cannot operate unless the vehicle has a certain minimum speed. Further, the scrubber should not operate if the vehicle is going too fast and the radar also has a maximum speed limit and when that is reached, the same type of shutdown will occur as when the speed of the vehicle drops too low. Once all the preconditions for operating the scrubber have been met, the control sequentially turns on the various pumps and motors forming a part of the scrubbing apparatus. This equipment will be maintained in an operating condition until one of the various sensors indicates that an improper operating condition is present at which time the machine will go through its shutdown procedure. The machine may be manually shut down and simply turned off, again by controls which form a part of the overall circuit.

Whereas the preferred form of the invention has been shown and described herein, it should be realized that there may be many modifications, substitutions and alterations thereto.

The embodiments of the invention in which an exclusive property or privilege is claimed are defined as follows:

1. A surface maintenance device for use in connection with a self-propelled vehicle including, one or more rotating brushes for cleaning a surface, brush drive means, actuating means connected to said brush drive means, sensor means for monitoring predetermined conditions associated with operation of said one or more brushes including means for monitoring vehicle speed, said sensor means being connected to and providing an operating signal for said actuating means when said sensor means indicate a predetermined acceptable vehicle speed.

2. The device of claim 1 further characterized by and including a brush force control circuit for raising and lowering said one or more brushes, said actuating means being connected to start said brush force control circuit when said sensor means indicate a predetermined acceptable vehicle speed.

3. The device of claim 2 further characterized in that said brush force control circuit functions to lift said brushes clear of said surface for transport.

4. The device of claim 3 further characterized in that said surface maintenance device is battery operated, said sensor means includes a monitor for battery charge level as a precondition to starting said brush drive means.

5. The device of claim 1 further characterized by and including a vacuum fan and drive motor associated therewith, said actuating means being connected to start said fan drive motor when said sensor means indicate a predetermined acceptable vehicle speed.

6. The device of claim 5 further characterized in that said one or more brushes perform a scrubbing operation, said device including a solution tank and a recovery tank, with said sensor means monitoring the conditions of said tanks and requiring predetermined acceptable conditions in them as a precondition to starting said brush drive means, brush force control and fan drive motor.

7. The device of claim 6 further characterized by and including a detergent tank, said sensor means monitoring the condition of said detergent tank as a predetermined acceptable condition to starting said brush drive means, brush pattern control and fan motor.

8. The device of claim 7 further characterized by and including a solution pump and a detergent pump, said actuating means being connected to start said pumps.

9. The device of claim 1 further characterized in that said vehicle is unattended when in operation.

10. The device of claim 1 further characterized by and including telemetry means for transmitting the conditions of said sensor means to a remote location.

11. The device of claim 1 further characterized in that said surface maintenance device is carried by and removable from said vehicle.

12. The device of claim 11 further characterized in that said sensor means includes a monitor for sensing the position of said floor maintenance device on said vehicle as a precondition to starting said brush drive means.

13. The device of claim 1 further characterized in that the means for monitoring vehicle speed includes a radar velocity sensor.

14. The device of claim 1 further characterized by and including means for automatically stopping said brush drive means said sensor means being connected to and providing an actuating signal for said means for automatically stopping said brush drive means.

15. A floor scrubber including, one or more rotating brushes for scrubbing a floor, drive motors for said brushes, a solution tank and a recovery tank for application and recovery of a cleaning solution, means for delivering cleaning solution to the floor being scrubbed and a fan for use in vacuuming used cleaning solution into said recovery tank, actuating means connected to said brush drive motors, solution delivery means and fan, sensor means for monitoring said solution tank and recovery tank, sensor means for monitoring travel speed of the floor scrubber, said sensor means providing a start signal for said actuating means when said tank sensor means detect predetermined levels in said tanks and when said speed sensor indicates the floor scrubber has reached a predetermined acceptable speed.

16. The floor scrubber of claim 15 further characterized by and including means for automatically stopping said brush drive motors, solution delivery means and fan, said sensor means being connected to and providing the actuating signal for said automatic stopping means.

17. The floor scrubber of claim 15 further characterized in that said floor scrubber is carried by and removable from a self-propelled vehicle.

18. The floor scrubber of claim 17 further characterized in that said scrubber and self-propelled vehicle are both unattended.

19. The floor scrubber of claim 17 further characterized in that said sensor means includes one or more monitors for sensing the position thereof on said vehicle and requiring a predetermined acceptable position as a precondition to starting said brush drive motors, solution delivery means and fan.

20. The floor scrubber of claim 15 further characterized by and including telemetry means for transmitting the conditions of said sensor means.

21. A floor scrubber including, one or more rotating brushes for scrubbing a floor, drive motors for said brushes, a solution tank and a recovery tank for application and recovery of a cleaning solution, means for delivering cleaning solution to the floor being scrubbed and means for delivering used cleaning solution to the recovery tank, actuating means connected to said brush drive motors and to said solution delivery means, sensor means for monitoring said solution tank and recovery tank, said sensor means providing an operating signal for said actuating means when said tank sensor means detect predetermined levels in said tanks, means for sensing the operating conditions of said brushes and controlling operation of said brushes in accordance with the sensed conditions thereof.

* * * * *